United States Patent [19]

Von Holdt

[11] Patent Number: 4,961,512

[45] Date of Patent: Oct. 9, 1990

[54] CHILDPROOF CLOSURE FOR LARGE CONTAINERS

[76] Inventor: John W. Von Holdt, 6864 Lexington La., Niles, Ill. 60648

[21] Appl. No.: 302,780

[22] Filed: Jan. 30, 1989

[51] Int. Cl.[5] ..... B65D 17/34

[52] U.S. Cl. ..... 220/270; 220/276; 215/216; 215/256

[58] Field of Search ..... 220/270, 276; 215/211, 215/213, 216, 256

[56] References Cited

U.S. PATENT DOCUMENTS

| | | | |
|---|---|---|---|
| 3,901,404 | 8/1975 | Feldman | 215/256 |
| 3,980,195 | 9/1976 | Fillmore | 215/256 |
| 4,512,493 | 4/1985 | Von Holdt | 220/270 X |
| 4,548,329 | 10/1985 | Curry | 215/216 |
| 4,687,112 | 8/1987 | Swartzbaugh | 215/216 |
| 4,711,364 | 12/1987 | Letica | 220/270 X |

*Primary Examiner*—Stephen Marcus
*Assistant Examiner*—Nova Stucker
*Attorney, Agent, or Firm*—Allegretti & Witcoff, Ltd.

[57] ABSTRACT

A screw top container lid defines child-proof opening means which are especially suitable for use with container lids of large size. The container lid has a top wall and a peripheral wall with an inner surface, typically with screw threads for attachment to a container lip. The inner surface of the peripheral wall also defines a ratchet for engagement with corresponding ratchet on a container when the lid is applied to it, to permit screw-threaded rotation of the lid in a tightening direction to seal the lid on the container in a closed condition, but to prevent counterrotation of the lid to permit removal from the container. A portion of the peripheral wall defines removable tear strip means. The tear strip carries at least some of the ratchet of the peripheral wall, with the result that a container carrying the lid in its closed condition may be opened by removing the tear strip to facilitate counterrotation of the lid. Desirably, a second portion of the ratchet of the peripheral wall remains after removal of the tear strip, to maintain a lock that normally prevents counterrotation. This ratchet portion may be in one or more sections, and may be proportioned to permit manual flexing thereof out of engagement with the corresponding ratchet of the container, so that the lid may be manually removed, but once again locked upon reapplication of the lid. By this means, its child-proof characteristic remains even after opening.

13 Claims, 1 Drawing Sheet

Fig.1
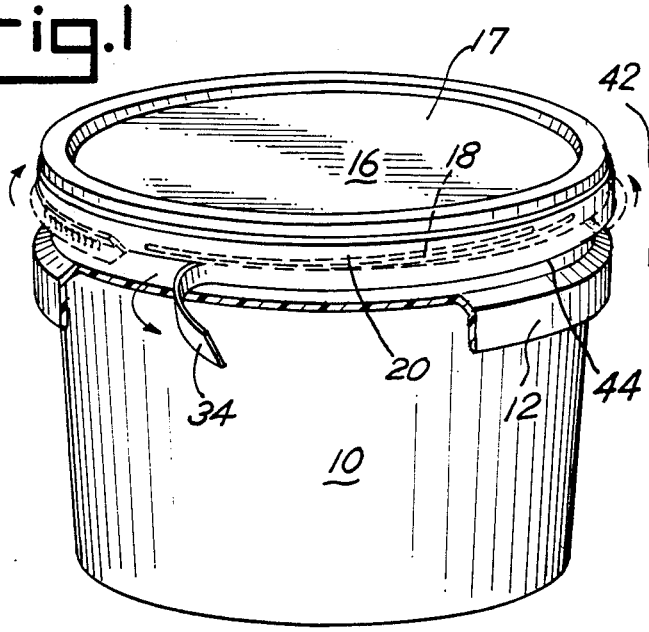
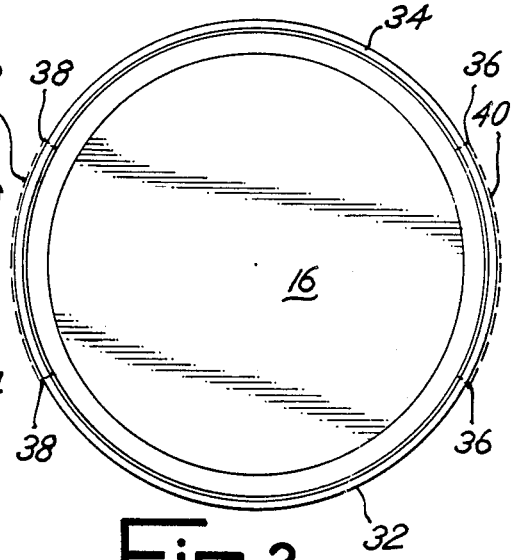
Fig.2
Fig.3
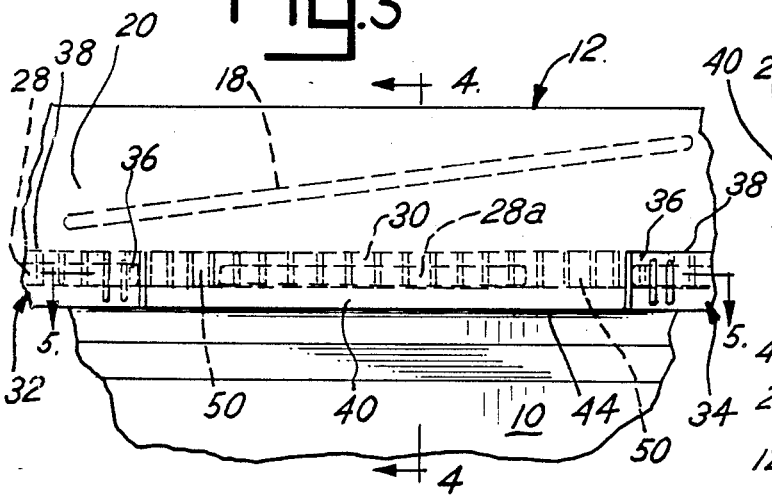
Fig.4
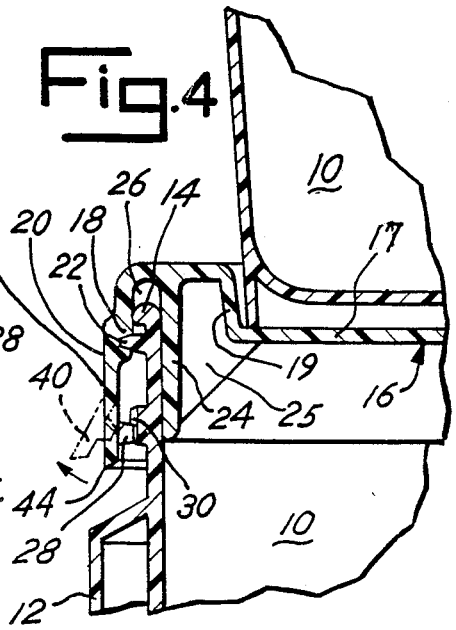
Fig.5
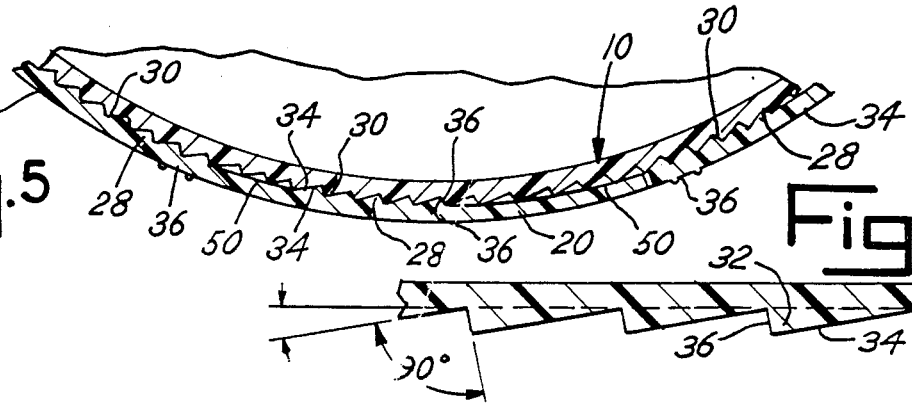
Fig.6
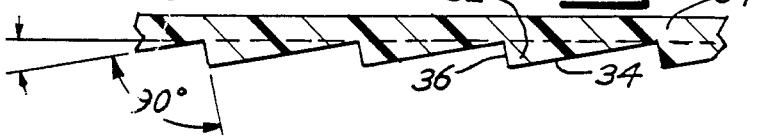

CHILDPROOF CLOSURE FOR LARGE CONTAINERS

BACKGROUND OF THE INVENTION

It is of course necessary to store many materials such as toxic chemicals in a container which cannot be opened by children, and innumerable designs of childproof containers are present in the prior art. However, most of these designs relate to small containers, and are generally impractical for use with respect to larger containers.

In accordance with this invention, a containersystem is provided in which a screw top lid contains a childproof closure for limiting access to the container. As one feature of the invention, the container lid may be of a design to permit positive reclosing after opening, while still retaining a locked characteristic which remains generally unopenable for smaller children. However, the container may be easily and manually opened by an adult user. Since the container can be relocked, it may be used to reseal volatile and toxic substances after initial opening.

DESCRIPTION OF THE INVENTION

In this invention, a screw-top container lid is provided which defines a top wall and a peripheral wall carried about the top wall. The peripheral wall has an inner surface that defines screw-thread attachment means.

In accordance with this invention, the inner surface of the peripheral wall also defines ratchet means for engagement with corresponding ratchet means on a container when the lid is applied thereto, the ratchet means being proportioned to permit screw-threaded rotation of the lid in a tightening direction so that the lid can be sealed on the container in closed condition. However, counterrotation of the lid is prevented by the interengaging ratchet means, to prevent its removal from the container.

A portion of the peripheral annular wall of the lid defines removable tear strip means, with the tear strip means carrying at least some of the ratchet means. Thus, a container carrying the lid in closed condition may be opened by removing the tear strip means, to thus facilitate the counterrotation and consequent removal of the lid from the container.

Preferably, not all of the ratchet means on the peripheral wall is carried on the tear strip means, so that a second portion of the ratchet means remains after removal of the tear strip means. The peripheral wall of the lid defines a free edge, the peripheral wall being preferably flexible to permit outward, manual flexing of portions of the edge and adjacent wall portions. It is desirable for the second portion of the ratchet means to be positioned near enough to the free edge of the peripheral wall to permit disengagement of that second portion of the ratchet means from the corresponding ratchet means on the bucket upon outward flexing of an edge portion.

Thus, that second portion of the ratchet means which is positioned in spaced relation to the tear strip means may be sized and positioned to permit its manual disengagement by a single user, by outward manual flexing of the edge portions. Then, it becomes possible to counterrotate the lid, while the remaining second ratchet portions are so outwardly flexed, to open the container after removal of the tear strip means. However, while the tear strip means are present, such outward manual flexing does not release the container lid for counterrotation, since at least some of the ratchet means on the lid will remain in engaging relation with the corresponding ratchet means on the container.

Accordingly, the container lid is childproof because one must first tear away the tear strips. Then, the remaining second ratchet portion or portions on the peripheral wall of the container lid are preferably sized so that only adult hands can disengage all of them from the corresponding ratchet portions on the container, to permit counterrotation of the container lid for opening.

The second portion of the ratchet means which are spaced from the tear strip means may be a single portion if desired, but preferably consist of a pair of diametrically opposed ratchet sections. However, any other desired arrangement may be used, if susceptible to essentially complete disengagement by the user by manual outward flexing of portions of the peripheral wall.

Preferably the peripheral wall is of annular shape, disposed about the entire container lid. Also, an inner, annular wall may be carried by the lid in substantially concentric relation with the peripheral wall, to define an annular slot which is proportioned to receive a container lip, to provide an improved seal between the container lip and the lid.

DESCRIPTION OF DRAWINGS

In the drawings, FIG. 1 is a perspective view of the container lid of this invention, shown carried on an open-mouthed container;

FIG. 2 is a plan view of the container lid of FIG. 1;

FIG. 3 is a greatly enlarged, fragmentary, elevational view of a portion of the peripheral wall of the container lid of FIG. 1, and also showing a portion of the container upon which it is carried;

FIG. 4 is a sectional view taken along line 4—4 of FIG. 3, also showing how containers and lids in accordance with this invention may be stacked;

FIG. 5 is a sectional view taken along line 5—5 of FIG. 3; and

FIG. 6 is a greatly enlarged sectional view, showing the shape of the individual ratchets of the peripheral wall of the container lid, and also the container.

DESCRIPTION OF SPECIFIC EMBODIMENTS

Referring to the drawings, container 10 is shown to be a wide-mouthed, tapered bucket, defining an annular strengthening rib 12 about its outer surface. Container 10 defines a lip 14 which is proportioned to carry lid 16 in screw-threaded relation thereon, typically making use of several multiple-start screw threads 18 of generally conventional design on the peripheral wall 20 of lid 16, and equally conventional, corresponding screw threads 22 projecting outwardly from the area of bucket lip 14. Typically, three or four multiple start threads 18, 22 may be provided for a short lid rotation of less than 180 degrees, as the lid is applied to and removed from container 10.

As shown in FIG. 4, lid 16 defines a top wall 17 having an annular step 19, which may be used to define an area to receive the bottom end of another bucket 10 for stacking of the buckets with their lids in place. Peripheral wall 20 may surround an inner, annular wall 24 which is carried by lid 16 in substantially concentric relation with peripheral wall 20, to define an annular slot 26, which is proportioned to receive container lip 14. Thus, a gentle pressure seal may be provided between inner annular wall 24 and the inner area adjacent bucket lip 14, for sealing purposes. Also, if desired, the top of lip 14 may seal against the uppermost end of slot 26 for added sealing. Radial stiffening ribs 25 may connect between inner wall 24 and the underside of lid 16 for strengthening purposes.

In accordance with this invention, the inner surface of peripheral wall 20 also defines ratchets 28, details of which are seen in FIGS. 5 and 6. When lid 16 is in its screw-threaded, closed position on container 10, ratchets 28 are engaged with corresponding ratchets 30, which are preferably positioned in an annular band about the entire outer periphery of container 10.

FIG. 6 is intended to show the detailed shape of both ratchets 28 and 30, and how, as is a well-known principle for ratchets, each individual ratchet 32 is a structure of generally pyramidal cross-section having a long side 34 and a short side 36, typically perpendicular to each other, with both sides 34, 36 being typically in acute angle relation to the plane of the wall 37 that carries them. As shown in FIG. 5, ratchets 28, 30 are positioned with their respective long sides 34 facing in opposite directions, so that the respective long sides 34 of ratchets 28, 30 can meet. Thus, it becomes relatively easy for the respective ratchets 28, 30, by simple mechanics, to rotate, with peripheral wall 20 moving in a counterclockwise direction relative to container 10, flexing slightly as it moves. However, it is much more difficult for peripheral wall 20 to move in the opposite direction with respect to container 10, because in permitted counterclockwise motion the respective long walls 34 slide by each other by lever action, but with clockwise motion, the shorter walls 36 interengage at a steeper angle to inhibit such motion. Thus, lid 16 may be manually rotated on the screw threads 22 of container 10 into closed condition, but it cannot be opened again by counterrotation under normal circumstances.

In the specific embodiment shown, container lid 16 defines a pair of tear strips 32, 34, each defining a tear tab 36 of generally conventional design, to permit breaking away of one end of each tear strip 32, 34 and then tearing of the tear strip circumferentially along line of weakness 38, with each tear strip typically extending about 120 to 170 degrees about the periphery of lid 16 to a breakaway section 38 that is typically present to permit removal of each torn-away tear strip from the remainder of lid 16.

The remaining sections 40, 42 of peripheral wall 20 typically are of essentially identical design, and are not removed by the removal of tear strips 32, 34. These sections 40, 42 are sized to permit manual outward flexing of the free edges 44 thereof, as shown in phantom in FIG. 4, to permit complete disengagement, of the second portion of ratchet segments 28*a* that remain on sections 40, 42 after tear strip removal, from the corresponding ratchets 30 carried on container 10. Thus, when the remaining sections 40, 42 are so flexed outwardly by the hands, it becomes possible to unscrew lid 16 from container 10 with the necessary rotation for separation of the two members being typically substantially less than one turn, typically about one quarter turn.

When it is desired to reattach the screw top lid 16 to container 10, one simply may conventionally screw it back on the container, since the remaining second ratchet sections 28 do not seriously interfere with the application of lid 16 as they engage with added ratchet section 30, while the lid is screwed on. However, the remaining second ratchet sections 28 still inhibit unscrewing of lid 16, unless one flexes sections 40 and 42 outwardly as described above.

Thus, the opened container still retains some of its childproof locking function after opening, since sections 40, 42 can be sized to make it substantially impossible for the small hands of even a strong child to outwardly flex all of sections 40, 42 sufficiently to disengage all of the remaining second ratchet portions 28 from corresponding ratchet 30 on the bucket.

Preferably, corresponding ratchet 30 on the bucket is a continuous, annular shape, while the portions of ratchet 28, carried on peripheral wall sections 40, 42, are separated by ratchet-free spaces 50 between the ratchet portions 28 defined on peripheral wall 20. This makes easier the breaking away of the tear strips at tear strip opening portions 36 and the corresponding tear-off of the tear strips at ends 38.

If desired, the tear strip may comprise a single strip that extends around most of the periphery of peripheral wall 20, leaving only a single portion of free edge 44 which is not torn away by the tear strip, so that only one section needs to be flexed outwardly to rotate lid 16 off of container 10. Additionally, other configurations of tear strips and untorn portions having a segment of free edge 44 may be provided as desired.

Accordingly, the container of this invention provides a screw- threaded lid capable of tightly sealing the container. At the same time, the opening process, while not difficult, exhibits childproof, protective characteristics, which protective characteristics are not lost by the initial opening of the container. Thus, the screw-threaded lid may be once again locked on the container after opening. The invention of this application is particularly useful with respect to large-mouthed containers, having a diameter on the order of four inches or more, while many childproof closures are only useful when their diameter is small.

The above has been offered for illustrative purposes only, and is not deemed to limit the scope of the invention of this application, which invention is as defined in the claims below.

THAT WHICH IS CLAIMED IS:

1. In a screw-top container lid which defines a top wall and a peripheral wall carried about said top wall, said peripheral wall having an inner surface that defines screw-threaded attachment means, the improvement comprising, in combination:

said peripheral wall being of annular shape and having a diameter of at least four inches;

said inner surface also defining ratchet means for engagement with corresponding ratchet means on a container when said lid is applied thereto, to permit screw-threaded rotation of the lid in a tightening direction to seal the lid on the container in closed condition, but to prevent counterrotation of the lid to permit removal from the container; and a portion of said peripheral wall defining removable tear strip means, said portion carrying some of said ratchet means, said peripheral wall defining a free edge, said peripheral wall being flexible to permit manually outward flexing of portions of said free edge and adjacent wall portions, a second portion of the ratchet means being positioned in spaced relation to the tear strip means, said second portion of the ratchet means comprising a pair of substantially diametrically opposed ratchet sections, said ratchet sections being sized and positioned to permit disengagement from the corresponding ratchet means by a single user by said manually, outward flexing of edge portions of said second portion, whereby a container carrying said lid in said closed condition may be opened by removing said tear strip means and said outward flexing of the edge portions of the second portion to disengage said second portion of the ratchet means, to facilitate said counterrotation of the lid.

2. The container lid of claim 1 in which said peripheral wall is annular.

3. The container lid of claim 2 in which an inner, annular wall is carried by the lid in substantially concentric relation with said peripheral wall, to define an annular slot proportioned to receive a container lip.

4. The container lid of claim 3 in which radial stiffening ribs connect said inner, annular wall and said top wall.

5. In a screw-top container lid with defines a top wall and a peripheral, annular wall carried about said top wall, said peripheral, annular wall having an inner surface that defines screw-thread attachment means, the improvement comprising, in combination:

said inner surface also defining ratchet means for engagement with corresponding ratchet means on a container when said lid is applied thereto, to permit screw-threaded rotation of the lid in a tightening direction to seal the lid on the container in closed condition, but to prevent counterrotation of the lid to permit removal from the container;

a portion of said peripheral, annular wall defining removable, circumferentially extending tear strip means, said portion carrying some of said ratchet means, whereby a container carrying said lid in closed condition may be opened by removing said tear strip means to facilitate said counterrotation of the lid, said peripheral wall defining a free edge, said peripheral wall being flexible to permit outward, manual flexing of portions of said edge and adjacent wall portions, a second portion of said ratchet means being spaced from the tear strip means, said second portion of the ratchet means defining a pair of diametrically opposed ratchet sections, said second portion being sized and positioned to permit said disengagement by a single user and positioned near enough to the free edge to permit disengagement of said second portion of the ratchet means from the corresponding ratchet means upon manual outward flexing of said second portions of the ratchet means.

6. The container lid of claim 5 in which an inner, annular wall is carried by the lid in substantially concentric relation with said peripheral wall, to define an annular slot proportioned to receive a container lip.

7. The container lid of claim 6 in which radial stiffening ribs connect said inner, annular wall and said top wall.

8. In a container which defines a container mouth, container screw thread means carried about the periphery of said container adjacent said mouth, and an attached screw-top container lid which defines a top wall and a peripheral wall carried about said top wall, and having an inner surface that defines inwardly projecting screw threads, said inwardly projecting screw threads being in threaded engagement with the container screw thread means, the lid being carried on the container to close the container mouth, the improvement comprising, in combination:

The inner surface of said peripheral wall also defining ratchet means, said container defining corresponding, outwardly projecting ratchet means, the ratchet means of the peripheral wall being in engagement with the corresponding ratchet means of the container, the respective ratchet means being proportioned to permit screw-threaded rotation of the lid onto the container in tightening direction to seal the lid on the container in closed position, but to prevent counterrotation of the lid on the container to permit removal from the container; a portion of said peripheral, annular wall defining removable tear strip means, said portion carrying some of said ratchet means of the peripheral wall, said peripheral wall defining a free edge and being flexible to permit outward, manual flexing of portions of said free edge and adjacent wall portions, the ratchet means of said peripheral wall being positioned near enough to said free edge to permit manual outward disengagement of a second portion of the ratchet means from the corresponding ratchet means on the container upon outward flexing of an edge portion, said second portion of the ratchet means being positioned in spaced relation from the tear strip means and defining a pair of diametrically opposed ratchet sections, said second portion of the ratchet means being sized and positioned to permit said manual disengagement by a single user, whereby said lid may be opened and removed from the container by removing said tear strip means and by said manual disengagement, to facilitate said counterrotation of the lid.

9. The container and lid of claim 8 in which said corresponding ratchet means on the container is continuous and annular.

10. The container and lid of claim 9 in which an inner, annular wall is carried by the lid in substantially concentric relation with said peripheral wall, to define an annular slot proportioned to receive a container lip.

11. The container and lid of claim 10 in which radial stiffening ribs connect said inner, annular wall and said top wall.

12. The container and lid of claim 8 in which said peripheral wall and said container mouth are respectively annular.

13. The container and lid of claim 12 in which said container mouth has a diameter of at least four inches.

* * * * *